US005253300A

United States Patent [19]

Knapp

[11] Patent Number: 5,253,300

[45] Date of Patent: Oct. 12, 1993

[54] SOLAR POWERED HEARING AID

[75] Inventor: Herbert C. Knapp, Grand Rapids, Mich.

[73] Assignee: H. C. Knapp Sound Technology Inc., Grand Rapids, Mich.

[21] Appl. No.: 720,654

[22] Filed: Jun. 25, 1991

Related U.S. Application Data

[63] Continuation-in-part of Ser. No. 673,931, Mar. 22, 1991.

[51] Int. Cl.[5] ..... H04R 25/00

[52] U.S. Cl. ..... 381/68.6; 381/68.7; 381/69.2; 136/291

[58] Field of Search ..... 381/69.2, 69, 68.7, 381/68, 68.4, 68.2, 68.6; 136/256, 291; 439/39, 38, 40

[56] References Cited

U.S. PATENT DOCUMENTS

| | | | |
|---|---|---|---|
| Re. 26,174 | 3/1967 | Leale | 179/107 |
| 1,624,131 | 4/1927 | Bobbitt . | |
| 1,867,423 | 7/1932 | Simsinovici . | |
| 2,899,624 | 8/1959 | Marriott | 320/48 |
| 2,901,551 | 8/1959 | Passow | 179/107 |
| 2,950,357 | 8/1960 | Mitchell et al. | 381/68.6 |
| 3,007,110 | 10/1961 | Rosenstrach | 324/53 |
| 3,265,819 | 8/1966 | Herrmann | 179/107 |
| 3,344,334 | 9/1967 | Rubin | 320/2 |
| 3,354,271 | 11/1967 | McDermaid | 179/107 |
| 3,493,695 | 2/1970 | Stork | 381/68.7 |
| 3,496,306 | 2/1970 | Pollak | 179/107 |
| 3,598,928 | 8/1971 | Hickox | 179/107 |
| 3,781,657 | 12/1973 | Dennstedt | 324/29.5 |
| 3,808,577 | 4/1974 | Mathauser | 439/39 |
| 3,810,258 | 5/1974 | Mathauser | 439/39 |
| 3,818,325 | 6/1974 | Boshers | 324/29.5 |
| 3,818,691 | 6/1974 | Uchiyama | 136/256 |
| 3,844,840 | 10/1974 | Bender | 136/89 |
| 3,940,679 | 2/1976 | Brandwein et al. | 320/48 |
| 3,998,045 | 12/1976 | Lester | 58/23 R |
| 4,056,765 | 11/1977 | Scheidler et al. | 320/48 |
| 4,095,217 | 6/1978 | Tani et al. | 340/324 |
| 4,163,194 | 7/1979 | Ross | 324/29.5 |
| 4,209,346 | 6/1980 | King | 136/89 |
| 4,307,330 | 12/1981 | Belot | 320/44 |
| 4,320,477 | 3/1982 | Baumgartner | 368/64 |
| 4,327,318 | 4/1982 | Kwon et al. | 320/39 |
| 4,363,407 | 12/1982 | Buckler et al. | 209/3.3 |
| 4,376,810 | 3/1983 | Takeda et al. | 429/90 |
| 4,379,988 | 4/1983 | Mattatall | 320/4 |
| 4,453,119 | 6/1984 | Staler et al. | 320/39 |
| 4,476,353 | 10/1984 | Haertl | 179/107 |
| 4,539,516 | 9/1985 | Thompson | 136/291 |
| 4,563,727 | 1/1986 | Curiel | 362/183 |
| 4,644,245 | 2/1987 | Brown | 320/13 |
| 4,648,013 | 3/1987 | Curiel | 362/183 |
| 4,759,070 | 7/1988 | Voroba et al. | 381/60 |
| 4,783,816 | 11/1988 | Büttner et al. | 381/68.7 |
| 4,786,851 | 11/1988 | Fuji et al. | 320/2 |
| 4,803,416 | 2/1989 | Abiven et al. | 320/44 |
| 4,809,458 | 3/1989 | Tanikuro et al. | 43/17.5 |
| 4,821,247 | 4/1989 | Grooms | 368/63 |
| 4,870,688 | 9/1989 | Voroba et al. | 381/60 |
| 4,904,078 | 2/1990 | Gorike | 351/158 |

FOREIGN PATENT DOCUMENTS

| | | | |
|---|---|---|---|
| 2625655 | 12/1977 | Fed. Rep. of Germany . | |
| 3501448 | 8/1985 | Fed. Rep. of Germany | 381/68 |
| 3723809 | 1/1989 | Fed. Rep. of Germany | 381/68.7 |

OTHER PUBLICATIONS

"The rechargeable hearing instrument system", Toni Gitles, Hearing Instruments, vol. 38, No. 7, 1987.

"The Dawn of a New Era in Hearing," by Solar Aid Corp.

"The Invisible Ear Model 150-A," by Lloyd Hearing Aid Corporation; The Invisible Ear Model 120-A by Lloyd Hearing Aid Corporation.

"Rhodes Hearing," publication.

*Primary Examiner*—Jin F. Ng

*Assistant Examiner*—Huyen D. Le

*Attorney, Agent, or Firm*—Price, Heneveld, Cooper, DeWitt & Litton

[57] ABSTRACT

Hearing aids include rechargeable batteries and contacts accessible from outside of the hearing aid casing for the battery. A charging case includes solar cells mounted on the charging case for outputting energy for charging the batteries in the hearing aids. The charging case may include silos for supporting an over-the-ear hearing aid or a recess for receiving a volume control on the hearing aid.

8 Claims, 6 Drawing Sheets

SOLAR POWERED HEARING AID

RELATED APPLICATIONS

This application is a continuation-in-part of application Ser. No. 07/673,931 filed Mar. 22, 1991 and entitled SOLAR POWERED HEARING AID.

BACKGROUND OF THE INVENTION

The present invention pertains to hearing aids, and in particular, to a hearing aid including an internal rechargeable battery mounted within the hearing aid.

Hearing aids typically include a battery for energizing the electrical components within the hearing aid. Hearing aids are known which include a battery removably carried with the hearing aid casing. For example, U.S. Pat. No. Re. 26,174 entitled HEARING AID and which issued to Leale on Mar. 21, 1967, discloses a battery holder which may be inserted and removed from the hearing aid to replace a battery carried therein. The holder provides easy access to the hearing aid battery as the user need not disassemble the hearing aid. However, new batteries must be purchased each time an old battery no longer has a sufficient charge for the hearing aid components, which is relatively costly. Furthermore, the appearance of hearing aids is very important to wearers, as an unattractive casing accents the fact that a hearing aid is inserted in the user's ear. A significant disadvantage of the hearing aids with doors is the doors are unattractive and discourage use of the hearing aid.

In-the-canal and over-the-ear hearing aids include replaceable batteries. These hearing aids consequently require that the batteries therein be replaced on a regular basis. Over-the-ear hearing aids include amplification circuits for users with severe hearing loss and use especially costly batteries. Regardless of whether the hearing aids are in-the-ear or over-the-ear, and regardless of the amplification provided by the hearing aid, the batteries must be replaced often. Because the batteries are costly to replace, these hearing aids are costly to maintain.

In-the-ear hearing aids are known which include externally accessible contacts coupled to an internal rechargeable battery. For example, U.S. Pat. No. 3,354,271 entitled SEALED HEARING AID and which issued to McDermaid on Mar. 21, 1967, discloses a hearing aid including contacts on the surface of the hearing aid through which charging current is supplied to a battery from a charger. The hearing aid does not include a door on the surface of the hearing aid casing. The charger is relatively heavy and large. It must be carried with the hearing aid in order to charge the internal battery. Such chargers must be plugged into the openings on the hearing aid. The small contacts of the plug can be difficult to manipulate into connection with the contacts on the hearing aid.

Solar powered hearing aids are known which allow the hearing aid battery to be charged from solar cells. One such hearing aid is disclosed in U.S. Pat. No. 2,901,551 entitled EYEGLASS HEARING AID and which issued to Passow on Aug. 25, 1959. As disclosed, an eyeglass frame has solar cells for supplying charging current to an internal rechargeable battery. The solar cell construction of the Passow patent cannot be used on an in-the-ear hearing aid due to the large array of the solar cells. Furthermore, the dark light responsive surface of the solar cells is visible through a transparent cover.

Another solar cell hearing aid includes a solar cell which is coupled to an internal rechargeable battery. The solar cell is mounted on the outside surface of the hearing aid casing behind a flesh colored door. To charge the solar cell, the door must be open. The door often falls off and is difficult to manipulate. Additionally, because the door is on the outside surface of the hearing aid, it is visible when the hearing aid is located within the user's ear. The door is unattractive and diminishes the appearance of the hearing aid.

SUMMARY OF THE INVENTION

In accordance with one embodiment of the present invention, a unique hearing aid is provided which includes electrical contacts accessible externally thereof to charge a battery in the hearing aid from external solar cells. Thus, the batteries in the hearing aid may be recharged without removing the battery from the hearing aid.

In another aspect of the invention, a charging case is provided which includes solar cells. The solar cells are electrically connected to contacts adapted to interconnect with contacts on the hearing aid. Thus, a small, lightweight, charger is provided which charges the batteries of a hearing aid from light.

These and other aspects, advantages and features of the invention will become apparent upon review of the following specification in combination with the drawings.

DETAILED DESCRIPTION OF THE PREFERRED EMBODIMENTS

It is to be understood that the specific devices and processes illustrated in the attached drawings, and described in the following specification, are simply exemplary embodiments of the inventive concepts defined in the appended claims. Hence, specific characteristics relating to the embodiments disclosed herein are not to be considered as limiting unless the claims expressly state otherwise.

Figure 2:
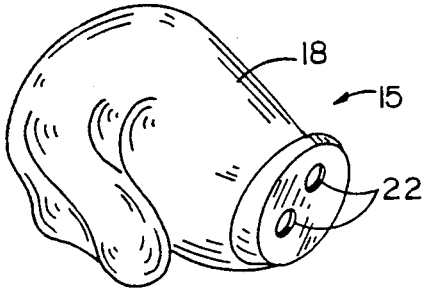
FIG. 2 is a perspective view of a rearward portion of the hearing aid.
Figure 1:
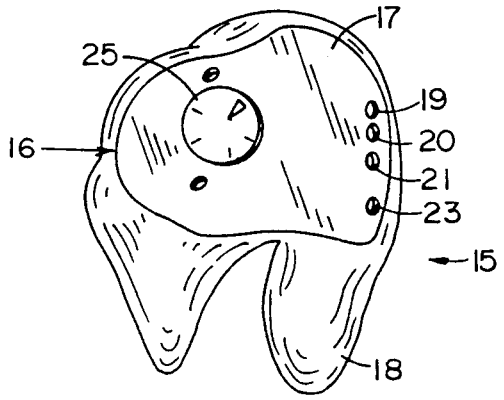
FIG. 1 is a perspective view of a forward portion of a hearing aid embodying the present invention.

Referring now specifically to the drawings, and the illustrative embodiments depicted therein, an in-the-ear hearing aid 15 (FIG. 1) includes a casing 16 formed by a face plate 17 and a rear casing 18. The face plate and rear casing are both flesh colored. The casing is aesthetically pleasing and does not suffer from unsightliness due to visual exposure of solar cells, doors and the like. Audio components 26 (FIG. 3) and power supply components 27 are disposed within casing 16. The face plate 17 includes apertures for terminals 19, 20 and 21 (FIGS. 1 and 3) which are electrically connected to internal solar cells 41 and 45 and an internal battery 38 which are carried within casing 16. As described in detail below, light passes directly through the face plate to the solar cells. Terminals 19, 20 and 21 are socket contact pins available from Electone. The face plate further defines an aperture 23 which passes sound waves to a microphone 28 positioned within the casing. The volume control dial 25 is carried on the face plate and is connected to a volume control potentiometer 52 enclosed within casing 16. Rear casing 18 includes a pair of openings 22 (FIG. 2) which pass sound waves emitted from a receiver 36 positioned within casing 16.

Microphone 28 (FIG. 3) has a signal output 29 connected to a capacitor $C_1$. A junction 31 is connected to $C_1$ and a signal input 32 of an amplifier 33. Amplifier 33 may be an LT 505 amplifier manufactured by Gennum Inc. Another amplifier which may be used to implement the circuit is a K-Amp available from Etymotic. Amplifier 33 has an output 34 which is connected to a receiver 36. Pin 1 of volume control potentiometer 52 is connected to the positive terminal of a capacitor $C_2$. The negative terminal of capacitor $C_2$ is connected to pin 7 of amplifier 33. Pin 2 of volume control potentiometer 52 is connected to a cathode of diode 49 and terminal 50 of battery 38. Pin 3 of volume control potentiometer 52 is connected directly to pin 5 of amplifier 33. Pin 4 of volume control potentiometer 52 is connected to junction 31 and pin 6 of amplifier 33. Pin 5 of volume control potentiometer 52 is connected to a trim potentiometer 37, receiver 36, microphone 28, and pin 4 of amplifier 33 to provide operating energy to these elements. Trim pot 37 is connected to the positive terminal of a capacitor $C_3$. The negative terminal of capacitor $C_3$ is connected to pin 1 of amplifier 33. Capacitors $C_2$ and $C_3$ may be implemented by 2.2 microfarad axial capacitors. Capacitor $C_1$, microphone 28 and receiver 36 are all selected according to the slope response required for the hearing aid user, and thus vary for each hearing aid.

Power supply components 27 include a rechargeable battery 38 having a negative terminal 39 connected to a negative terminal 40 of solar cell 41. Battery 38 may be a DK30 battery manufactured by Varta. A positive terminal 42 of cell 41 is connected by conductor 43 to a negative terminal 44 of cell 45. A positive terminal 46 of cell 45 is connected to the anode of a diode 49. Diode 49 may be an IN914 diode. The anode of diode 49 is connected to positive terminal 50 of battery 38. The cathode of diode 49 and battery terminal 50 are connected to pin 2 of volume control potentiometer 52.

Cells 41 and 45 are WPI-5 photovoltaic cells manufactured for Wein Products Inc. The solar cells produce a 0.25 mA current and a 0.5 volt potential when placed in direct sunlight. The solar cells are attached to the hearing aid by melting the solar cells into face plate 17 with the light responsive surface of the solar cells facing the face plate. In order to insure that sufficient light passes to the cells and that the hearing aid is aesthetically pleasing, it is presently preferred that face plate 17 be translucent but not transparent or opaque. In an existing embodiment, plate 17 has a thickness of 1.27 millimeters and is manufactured by Resistance Technology Incorporated under the designation RTI 10A-Fleshtone Face Plate.

In operation, acoustic signals are converted to electrical output signals by microphone 28. The electrical output signals are supplied via capacitor $C_1$ to audio input 32 of amplifier 33. Amplifier 33 receives the signals output from microphone 28 and outputs amplified, compressed, signals o output 34. The amplified output is converted to acoustic signals by receiver 36. The volume control potentiometer 52 is used to adjust the volume of the amplifier whereby the user may adjust the loudness of the signal applied to his/her eardrum. Trim potentiometer 37 adjusts the output compression of amplifier 33.

The power supply for the hearing aid electrical components is provided by rechargeable battery 38 and solar cells 41 and 45. The battery is connected in parallel with solar cells 41 and 45 which are essentially connected in series. The solar cells produce an output current and potential which charges battery 38 when the output voltage of the solar cell is greater than the voltage on battery 38. When the solar cells generate a lower voltage than battery 38, the battery supplies energy to the hearing aid audio components, and diode 49 isolates solar cell terminal 46 from battery terminal 50.

Battery 38 in hearing aid 15 is charged by the current produced from solar cells 41 and 45 when hearing aid face plate 16 faces an illuminated incandescent or halogen light source. For example, battery 38 charges when the hearing aid is placed under a table lamp having an incandescent light bulb when face plate 16 oriented toward the light bulb. The battery also charges when the hearing aid is in a wearer's ear which faces an incandescent light bulb. Thus, light from a reading lamp will charge the battery while a wearer reads. Of course, sunlight incident upon face plate 16 charges battery 38.

Current and voltage sensor 60 is used to monitor the charge on battery 38 and the current supplied by solar cells 41 and 45. Sensor 60 includes a male plug 61 having three male contacts (not shown) for insertion in hearing aid 15 to electrically connect to terminals 19–21. Three conductors are provided in cable 62 to connect the terminals 19–21 to circuitry within housing 63 of sensor 60. Plug 61 and cable 62 are a bi-cross cord which is available from Electone Inc. Current and voltage sensors in indicator 60 may be implemented by any off-the-shelf analog or digital meters which translate current and voltage to mechanical movement as is well known. The current and voltage detectors are accordingly not described in greater detail herein. A current indicator 64 preferably includes a red indicator 64A and a green indicator 64B which indicate that the current magnitude is not sufficient to charge the battery and that the current magnitude is sufficient to charge the battery, respectively. A voltage indicator 65 preferably includes a red indicator 65A and a green indicator 65B which indicate that the voltage on the battery is not sufficient to drive the electrical elements of circuit 27, or that it is sufficient to drive the electrical elements of circuit 27, respectively.

In operation, indicator 64 displays the magnitude of the current generated by cells 41 and 45, and indicates whether the current magnitude is large enough to charge the battery. Indicator 65 displays the magnitude of that voltage on battery 38, and whether that voltage is large enough to energize elements 28, 33 and 36.

Figure 5:
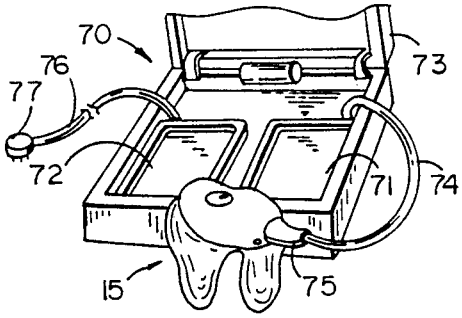
FIG. 5 is a perspective view of the inside of a portable recharging box which may be used with the hearing aid.

A portable charger case 70 (FIG. 5) may be used to charge battery 38 using external solar cell 71 or solar cell 72. Case 70 comprises a box 73 having a first cell 71 and a second cell 72 mounted therein. Cells 71 and 72 may be implemented by No. 34064 solar cells manufactured by Edmond Scientific which are encased photovoltaic cells. Cell 71 is illustrated connected to hearing aid 15 by cable 74 and plug 75. A cable 76 and a male plug 77 are connected to cell 72 for charging another hearing aid. Case 70 is relatively lightweight and compact as it includes essentially solar cells 71 and 72, the electrical cables 74 and 76, and connectors 75 and 77.

Figure 3:
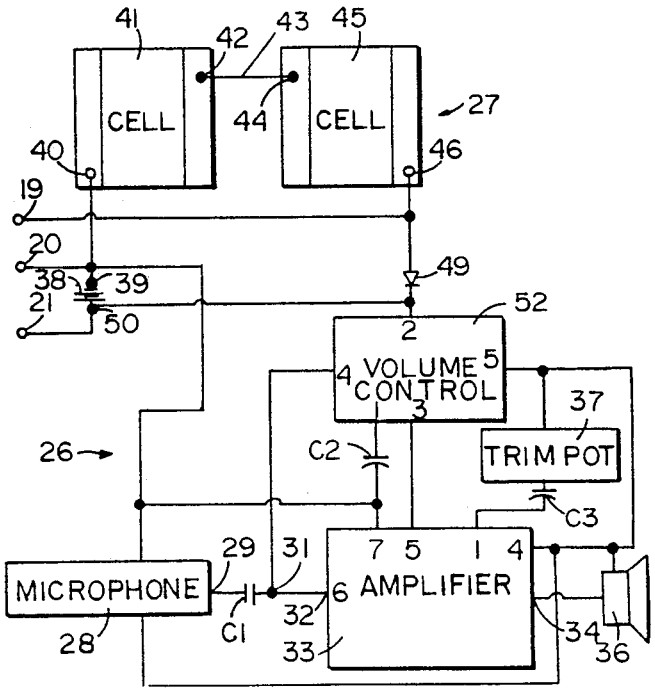
FIG. 3 is a schematic diagram of a circuit for implementing the hearing aid.
Figure 6:
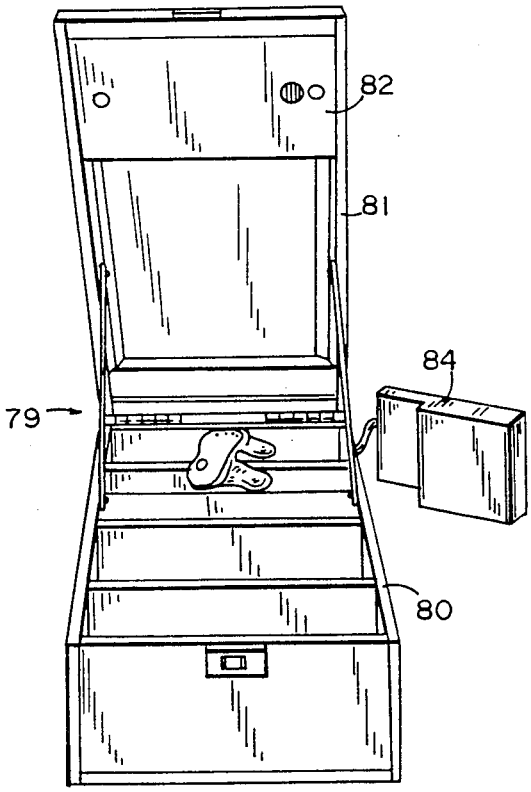
FIG. 6 is a perspective view of the inside of a carry/-charge container which may be used with the hearing aid.

A hearing aid carry case 79 (FIG. 6) may be used with the solar powered hearing aids embodying the invention to carry hearing aids and provide a source of light for charging internal battery 38 using internal photo cells 41 and 45 (FIG. 3). The carry case includes a base 80 and a lid 81. Because fluorescent light does not provide sufficient light for charging battery 38, the carry case includes either an incandescent or a halogen light source in a light source portion 82 in lid 81. A 20 watt, 12-volt halogen light bulb may be used in carry case 79, although most preferably a table lamp would be used to supply light to solar cells 41 and 45. An AC wall outlet plug 84 provides energizing current to the light bulb positioned within light source portion 82. Module 84 is removably plugged into base 80 of carry case 79 and may be carried within base 80 when not in use. The module may be implemented by a Colrad AC adaptor 45-775 which outputs a 12 volt and a 40 VA power supply from a 120 volt, 60 Hz, power supply.

Figure 7:
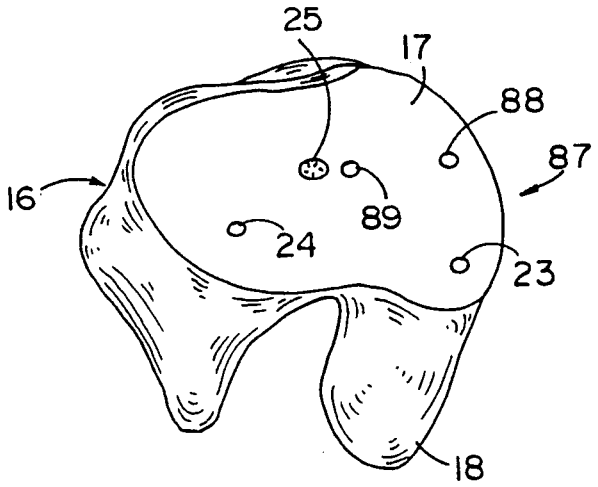
FIG. 7 is a forward perspective view of a hearing aid according to an alternate embodiment of the invention.

Hearing aid 87 (FIG. 7) is an alternate embodiment of hearing aid 15 and includes a casing 16 formed from face plate 17 and a base casing 18. The circuit inside hearing aid 87 is the same as the circuit in hearing aid 15 illustrated in FIG. 3. The face plate has an aperture 23 which provides a sound passage to microphone 28 positioned within the casing. The face plate further includes a compression control 24 and a volume control dial 25. Hearing aid 87 also has a pair of electrical terminals 88 and 89 which may be implemented by round-headed pins made from nickel plated steel. Terminals 88 and 89 are coupled to terminal 50 (FIG. 3) and terminal 39, respectively, of battery 38 of power supply circuit components 27.

Figure 9A:
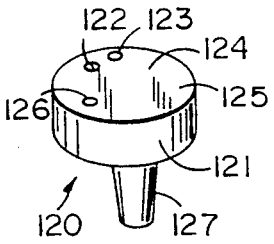
FIG. 9*a* is a top perspective view of another embodiment of an in-the-canal hearing aid.
Figure 9B:
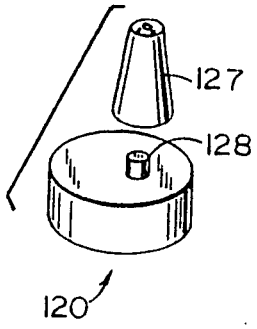
FIG. 9*b* is a bottom perspective view of the in-the-canal hearing aid of FIG. 9*a;*
Figure 4:
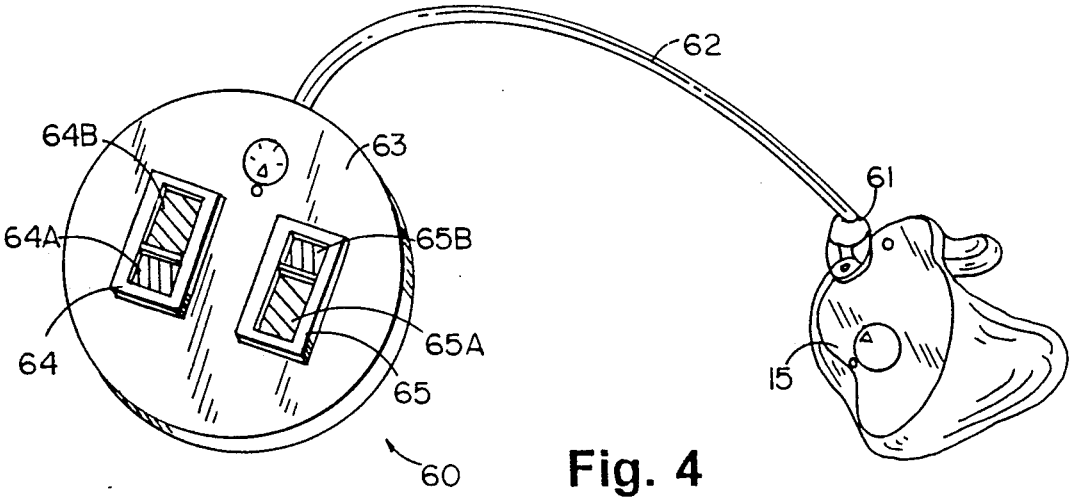
FIG. 4 is a perspective view of a measuring device used with the hearing aid.
Figure 8:
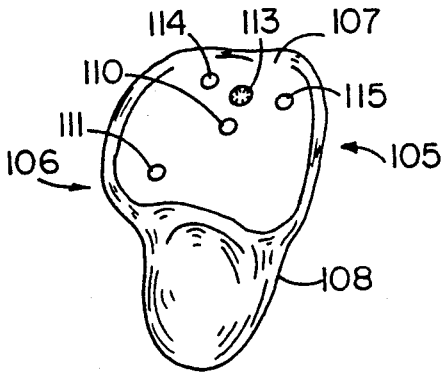
FIG. 8 is a forward perspective of an in-the-canal hearing aid according to an alternate embodiment of the invention.

An in-the-canal hearing aid 105 (FIG. 8) includes a casing 106 having a face plate 107 and a base casing 108. Face plate 107 may be implemented by a standard face plate manufactured by RTI, as is well known. The face plate contains terminals 110 and 111 which are formed by nickel plated steel round-headed pins which project through the face plate. The face plate further includes a volume control 113, a microphone aperture 114 and a compression control 115. The in-the-canal hearing aid of FIG. 9 comprises the circuit of FIG. 3 minus the solar cells 41 and 45 and diode 49. Terminals 110 and 111 are electrically coupled to terminals 50 (FIG. 3) and 39, respectively, of battery 38.

Hearing aid 120 (FIGS. 9*a* and 9*b*) is another embodiment of an in-the-canal rechargeable hearing aid. Hearing aid 120, like hearing aid 105, does not include internal solar cells. Hearing aid 120 has a casing 121 which encloses the hearing aid circuit, which is the circuit illustrated in FIG. 3 minus the two internal solar cells 41 and 45 and diode 49. Casing 121 includes a volume control 122, a compression control 123, a pair of terminals 124 and 125 and a aperture 126 which provides a sound passage to microphone 28 located therein. A canal piece 127 (FIG. 9*b*) includes a threaded aperture (not shown) which is received on threaded pipe 128. The threaded pipe is molded the into casing 121, and includes an aperture for passing sound output from receiver 36 located within casing 121. The canal piece 127 is most preferably a canal piece sold under the trademark "COMPLY" and manufactured by 3M Corporation. The threaded pipe 128 is also available from 3M and provides a mating connection with the threaded aperture of the canal member. Terminals 124 and 125 are connected to terminals 50 (FIG. 3) and 39, respectively, of battery 38.

Figure 10A:
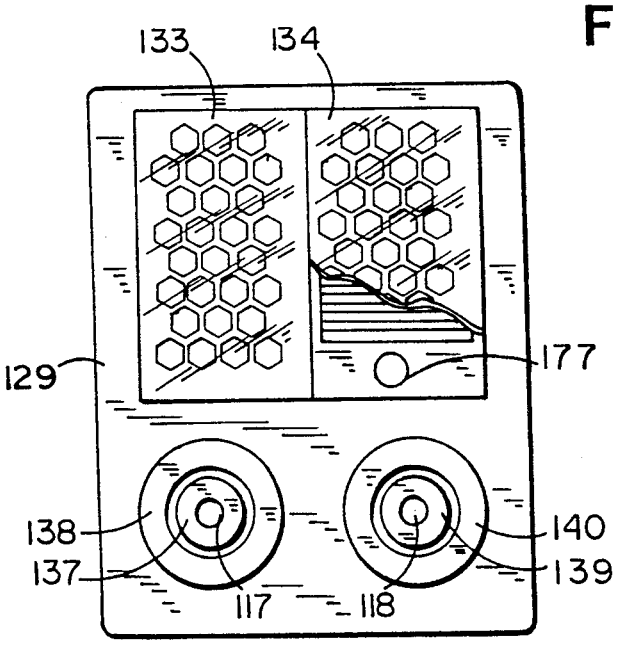
FIG. 10*a* is a top elevational view of the inside surface of the charging box of FIG. 10 with LEDs in the charging cell cases.

A case 130 (FIG. 10) is an alternate embodiment of case 70 for use with the hearing aids of FIGS. 7, 8, 9*a* and 9*b*. Case 130 has a base 131 and a lid 132 which are connected by hinges (not shown). Base 131 has non-magnetic negative contacts 137 and 139 and magnetic positive contacts 138 and 140 mounted on an interior surface 129 thereof. Contacts 137 and 138 form a connector connected to a light emitting diode (LED) (light emitting diode) 135 and a solar cell 133. Contacts 139 and 140 form a connector connected to an LED 136 and a solar cell 134. Magnetic contacts 138 and 140 may be formed by placing a washer over magnets positioned within base 131. Solar cells 133 and 134 may be implemented by a solar cell No. 34064 manufactured by Edmond Scientific which is an encased solar cell. A central recess 117 and a central recess 118 are formed in surface 129. The central recesses are shaped to receive volume controls 25, 113 and 122 on hearing aids 87 and 105 when the hearing aids are placed on surface 129 for recharging the batteries in the hearing aids. With reference to FIG. 10*a*, LEDs 135 and 136 may be mounted within the case of charging cells 133 and 134 to permit surface 129, and thus case 130, to be more compact. In this embodiment, LEDs 135 and 136 are preferably positioned adjacent the light responsive surface in cells 134 and 135 as illustrated by LED 135 adjuacent light responsive surface 134*a* in cell 134.

Figure 11:
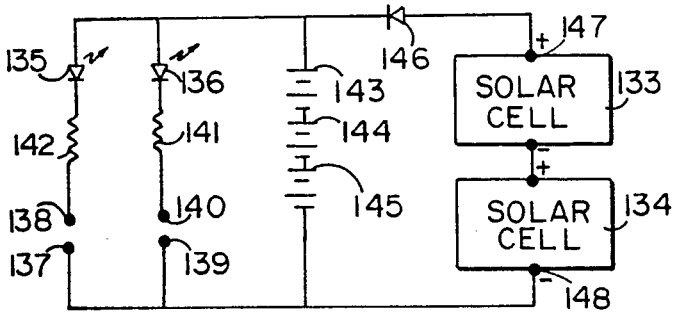
FIG. 11 is a schematic diagram of the circuit in the base of the box illustrated in FIG. 10.

The electronic circuit located within base 131 of box 130 is illustrated in FIG. 11. Contacts 137 and 138 are connected in series with a resistor 142 and an LED 135. Contacts 139 and 140 are connected in series with a resistor 141 and an LED 136. Resistors 141 and 142 dissipate the large current output by solar cells 133 and 134. Three nicad batteries 143, 144 and 145 are connected in series. Batteries 143-145 may be a Radio Shack nicad battery unit, catalog No. 23-177. Solar cells 133 and 134 are connected in series. The positive terminal 147 of solar cell 133 is connected to the anode of a diode 146. The cathode of diode 146 is connected to the positive terminal of battery 143. The negative terminal of battery 145 is connected to the negative terminal of battery 145.

Figure 12:
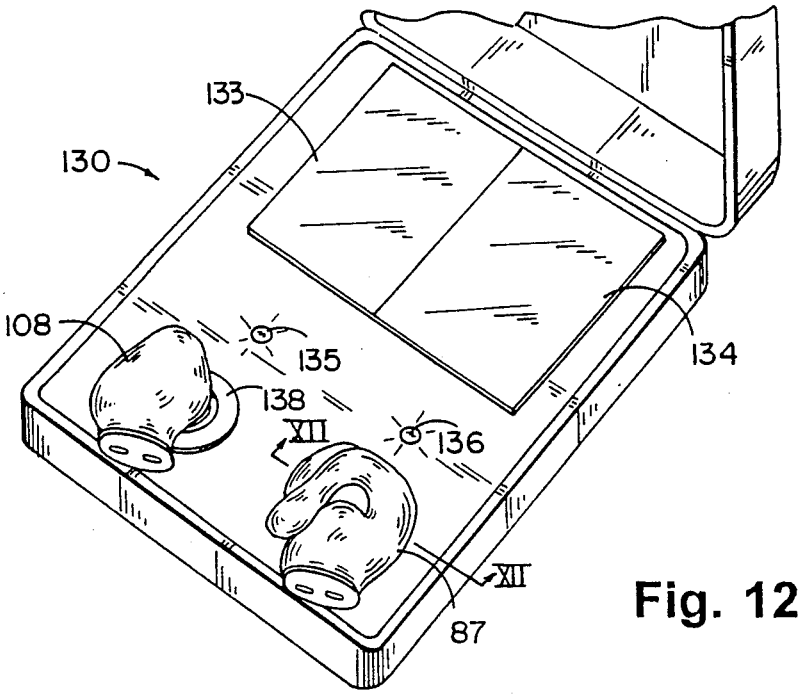
FIG. 12 is a perspective view of an open charging box charging the hearing aids of FIGS. 7 and 8.
Figure 12A:
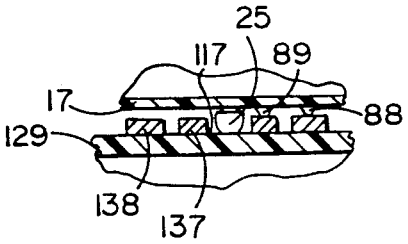
FIG. 12*a* is a sectional view of the charging contacts and the hearing aid of FIG. 7 taken along plane XII—XII in FIG. 12.

In operation, to charge the battery carried within casing 16 (FIG. 7), casing 106 (FIG. 8), or casing 121 (FIGS. 9*a* and 9*b*), the user places terminals 88 and 89, 110 and 111, or 124 and 125 in electrical contact with contacts 137 (FIG. 10) and 138, or 139 and 140. Magnetic contacts 140 and 138 will attract the hearing aid terminals toward the correct charging position. With reference to FIG. 12*a*, volume control 25 is inserted into central recess 117 and terminals 88 and 89 interconnect with contacts 137 and 138. The volume control knobs 25, 113 or 122 are received in central openings 117 or 118 to position terminals 88 and 89, 110 and 111, or 124 and 125 to contact the contacts 137 and 138 or 139 and 140 on the charger case. Accordingly, the central recesses assist the hearing aid user in positioning the hearing aids on the charger since the user will know when the volume control is in the recess. When the volume control knob is inserted, the central openings, the polarity of the rechargeable battery in the hearing aid is the same as the polarity of the contacts on the charger case. LEDs 135 and 136 provide a visual indication that the hearing aids are properly positioned to complete the circuit (FIG. 11) in charger 130 (FIG. 10), as illustrated by hearing aids 105 and 87 in FIG. 12. The LEDs illuminate when the internal batteries in the hearing aids are being charged by batteries 143-145 or solar cells 133 and 134.

Batteries 143-145 will provide sufficient output to charge the batteries within the hearing aids when the solar cells are not producing sufficient power to charge the hearing aid batteries. Additionally, the three batteries will hold the charge such that the unit will not need to be placed near a high energy light source more than once a month. For example, if the casing is left in a room with fluorescent lighting for a month, the casing would have to be placed near a high energy light source at the end of the month in order to charge batteries 143-145. On the other hand, if the casing is typically left near an incandescent light source, the batteries 143-145 will be charged on a regular basis from solar cells 133 and 134 and box 130 would not have to be placed near a high energy light source to charge batteries 143-145.

An over-the-ear hearing aid 150 (FIG. 13) includes a casing 151 which houses electronic circuits and is for placement over a user's ear. Audio circuits for over-the-ear hearing aids are well known, and manufactured by companies such as Electone. Accordingly, the circuit in housing 151 is not described in greater detail herein. Hearing aid 150 according to the invention includes a rechargeable battery 152, such as a Varta DK-30, which is mounted within housing 151. A cap 153 is assembled over casing 151 and secures battery 152 within the case. Cap 153 includes a terminal 158 connected by a conductor (not shown) to the positive terminal of battery 152 and a terminal 159 electrically connected by a conductor (not shown) to the negative terminal of battery 152. Terminals 158 and 159 are provided on the outside surface of cap 153 to provide external electrical access to the battery. Alternatively, terminals 158 and 159 may be provided on hearing aid casing 151, with the electrical terminals 158 and 159 extending through casing 151. A threaded fastener 154 is inserted through opening 155 and received in threaded bore 156 to secure the cap on housing 151. When the hearing aid 150 is assembled, the battery is secured in the hearing aid and need only be replaced about once a year. The hearing aid includes a receiver tube 157 which connects to housing 151. A hearing aid receiver is connected via receiver tube and an ear tube that assembles over receiver tube 157 to provide a sound passage from the receiver in housing 151 to the user's ear canal as is well known.

Figure 13:
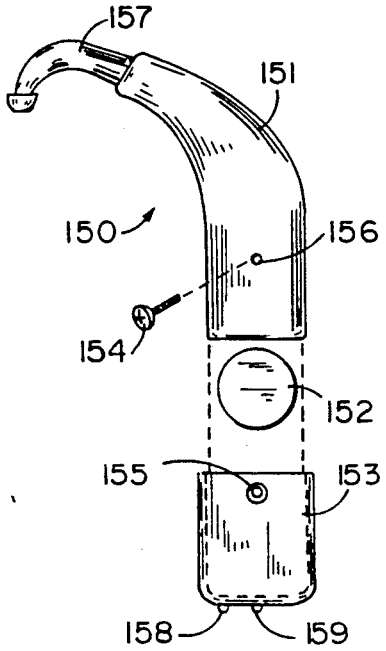
FIG. 13 is an exploded view of an over-the-ear hearing aid according to another embodiment of the invention.
Figure 14:
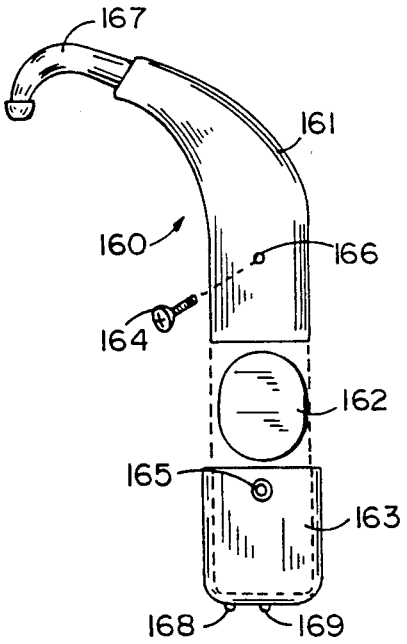
FIG. 14 is an exploded view of an over-the-ear hearing aid according to another embodiment of the invention.

An alternate embodiment of the hearing aid of FIG. 13 is illustrated in FIG. 14. Hearing aid 160 is a high-gain over-the-ear hearing aid. High-gain over-the-ear hearing aids are well known such as the Fidelity F-170 sold by Starkie, which is imported from Switzerland where it is manufactured by Bomer. These over-the-ear hearing aids are manufactured for people with severe hearing losses. The high-gain over-the-ear hearing aid according to the invention includes a casing 161 partially housing battery 162. Battery 162 is a Varta DK-100, which is a rechargeable battery. A cap 163 is assembled over casing 161 of the hearing aid to enclose battery 162. Cap 163 includes terminals 168 and 169 which extend through a bottom wall of cap 163 and are connected by conductors (not shown) to positive and negative terminals of battery 162. The cap is secured to casing 161 by a threaded fastener 164 inserted through bore 165 and received in threaded bore 166. Threaded fastener 164 is inserted in threaded bore 166 to affix cap 163 on housing 161. The hearing aid further includes a receiver tube 167 assembled to housing 161 as is well known.

Figure 15:
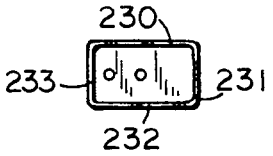
FIG. 15 is a top view of a cap for the hearing aids of FIGS. 13 and 14.
Figure 16:
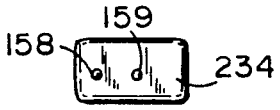
FIG. 16 is a bottom view of a cap for the hearing aids of FIGS. 13 and 14.

Caps 153 and 163 are shaped to fit snuggly on housings 151 and 161, respectively. Caps 153 and 163 are identical except for the dimensions of the caps and accordingly only cap 153 is illustrated further. Cap 153 is generally rectangular and includes sidewalls 230 (FIG. 15), 231, 232 and 233 and a bottom wall 234. Terminals 158 and 159 extend through the bottom wall 235. A conductor (not shown) is mounted in the interior of cap 153 and connects the positive terminal of battery 152 to terminal 158. Another conductor (not shown) is mounted in the interior of cap 153 and connects the negative terminal of battery 152 and terminals 159. Recharging power is supplied to battery 152 via terminals 158 and 159.

Figure 10:
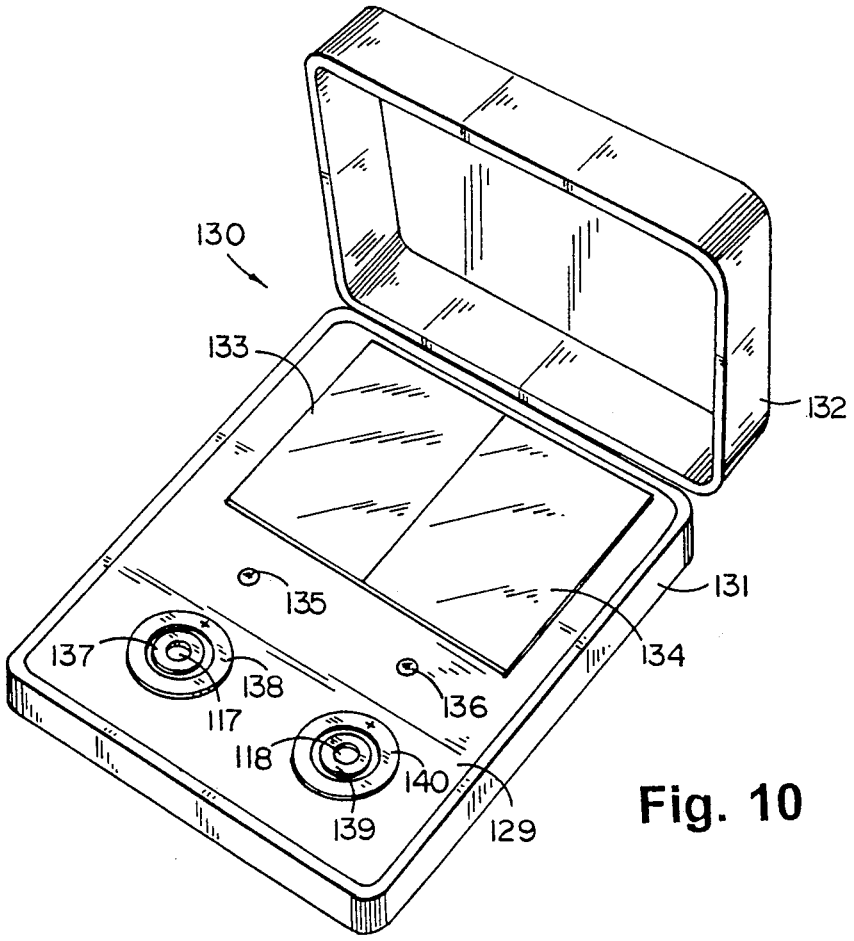
FIG. 10 is a perspective view of an open charging box for charging the hearing aids of FIGS. 7–9*b;*
Figure 17:
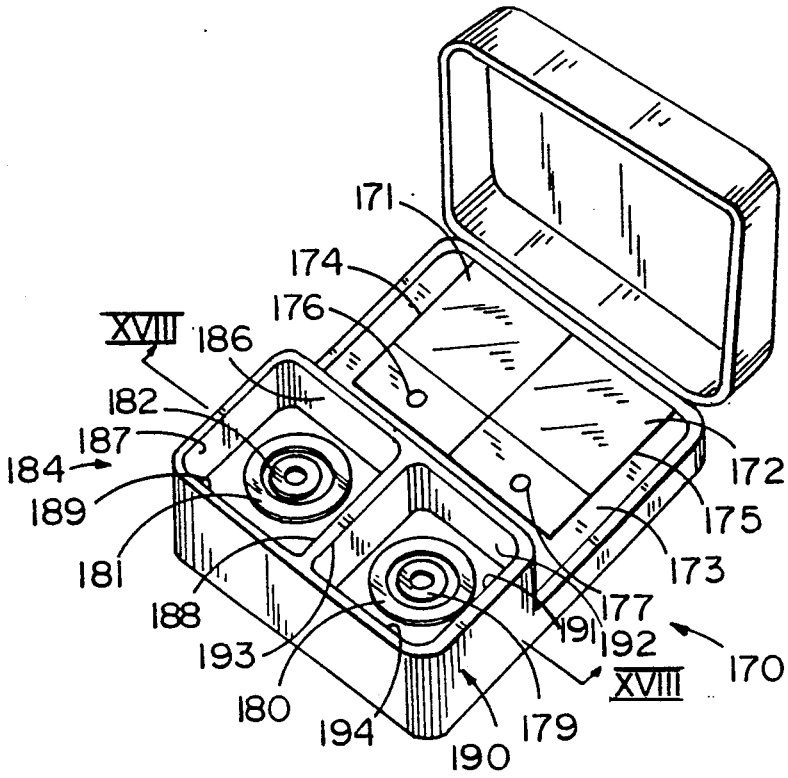
FIG. 17 is a perspective view of an open charging box for charging the hearing aid of FIGS. 13 and 14.
Figure 18:
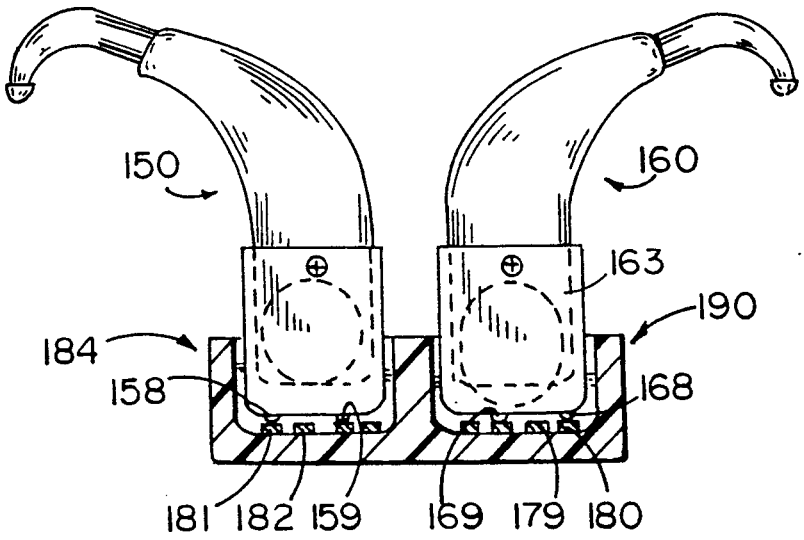
FIG. 18 is a sectional side view of over-the-ear hearing aids according to FIGS. 13 and 14 on the charging box of FIG. 17 taken along plane XVIII—XVIII in FIG. 17.

A portable charging case 170 (FIG. 17) is an alternate embodiment of casing 130 illustrated in FIG. 10 for use with the hearing aids of FIGS. 13 and 14. Casing 170 is used to charge batteries 152 and 162 in over-the-ear hearing aids 150 and 160 using solar cells 171 and 172. Charging case 170 includes cells 171 and 172 on an interior surface 173 of the case. Cells 171 and 172 may be implemented by number 34064 solar cells manufactured by Edmond scientific which are photovoltaic cells encased in casings 174 and 175. An LED 176 is assembled in casing 174 housing cell 171 and an LED 177 is assembled in case 175 housing cell 172. LEDs 176 and 177 are assembled in casing 174 and 175 by forming a hole in cases 174 and 175 and inserting the LEDs therein.

The circuit in casing 170 is identical to the circuit in casing 130 illustrated in FIG. 11. Contacts 179 and 182 are connected to the negative terminal of storage batteries 143-145 (FIG. 11) in case 170 and contacts 180 and 181 are connected to the positive terminal of batteries 143-145. The case further includes vertical silos for supporting hearing aids 150 and 160 in a vertical position. Silo 184 includes a back wall 186, an outside wall 187, an inside wall 188 and a front wall 189. Silo 190 includes a back wall 191, an outside wall 192, an inside wall 193 and a front wall 194. Inside walls 188 and 193 are preferably formed by an integral wall. Preferably, contacts 179 and 180 of one connector and silo 190 are concentric. Contacts 181 and 182 of another connector and silo 184 are also preferably concentric.

To charge hearing aids 150 and 160, hearing aids 150 and 160 are inserted into silos 184 and 190. When hearing aids 150 is fully received in silo 184, terminal 159 connects with contact 182 and terminal 158 connects with contact 181. Similarly, when hearing aid 160 is fully inserted in silo 190, terminal 169 connects with contact 179 and terminal 168 connects with contact 180. Silos 184 and 190 insure that terminals 158, 159, 168 and 169 make proper contact with contacts 179-182

When hearing aids 150 and 160 are inserted into silos 184 and 190, caps 152 and 162, which are slightly smaller than the silos, are received in the silos. Terminals 158, 159, 168 and 169 interconnect with contacts 179-182 such that the hearing aid batteries have the same polarity as the recharger contacts. The polarity of the hearing aid battery relative to the recharger contacts is assured due to the spacing of the terminals on caps 153 and 163 and the concentric positioning of contacts 179-182 in silos 184 and 190. Terminals 158 and 168 will thus connect with contacts 180 and 181 and terminals 159 and 169 will connect with contacts 179 and 182 when caps 153 and 163 of hearing aids 150 and 160 are inserted into the silos regardless of their rotational position within the silos. Additionally, LEDs 176 and 177 illuminate when a proper contact is made between the hearing aid connector and the charging connectors to assure the user that a connection is made.

Thus it can be seen that hearing aids are disclosed which are aesthetically pleasing and include rechargeable batteries. Solar powered battery recharger is also disclosed which recharges the batteries and insures that the polarity of the hearing aid batteries and the polarity of the charger contacts are the same.

Of course, it is to be understood that the above descriptions are those of the preferred embodiments of the invention. Various other embodiments, as well as many changes and alterations, may be made without departing from the spirit and broader aspects of the invention, as defined in the claims.

The embodiments of the invention in which an exclusive property or privilege is claimed are defined as follows:

1. In combination, a charger for a hearing aid and a hearing aid including a battery, comprising:

a charger box, said box including contacts carried on a surface of said casing, said contacts coupled to a source of charging energy; and terminals on said hearing aid coupled to said hearing aid battery, said terminals on said hearing aid adapted to connect with said contacts;

wherein said contacts and said terminals are magnetic and one of said contacts and said terminals has a magnetic force which magnetically attracts the other one of said contacts and said terminals whereby said hearing aid is attracted to a position where the hearing aid terminals are connected to the contacts such that energy from said source of charging energy is input to said battery and said battery is charged when said contacts on said box and said hearing aid terminals are interconnected, and said charger box further includes a recess and said hearing aid further includes a volume control, whereby said volume control is received in said recess when said hearing aid terminals are connected to said contacts to insure the polarity of the hearing aid batteries is the same as the polarity of the charger contacts.

2. The charger and hearing aid as defined in claim 1, wherein one of said contacts at least partially encircles said recess and another one of said contacts at least partially encircles said one of said charger contacts.

3. The charger and hearing aid as defined in claim 1, wherein said hearing aid is an in-the-canal hearing aid.

4. The charger and hearing aid as defined in claim 1, wherein said hearing aid is an in-the-ear hearing aid which includes internal solar cells.

5. A charger for a hearing aid having a rechargeable battery and magnetic terminals coupled to the rechargeable battery, comprising:

a casing including a source of charging energy carried in said casing;

at least one connector coupled to said source of charging energy, said at least one connector adapted to connect with first and second terminals of a hearing aid whereby energy output by said source of charging energy can be coupled to a battery mounted within the hearing aid;

wherein said at least one connector includes at least one magnetic contact such that the terminals of the hearing aid and said at least one contact are magnetically attracted to assist in positioning the terminals of the hearing aid on said contacts for charging the battery in the hearing aid from said source of charging energy, and said casing further includes a recess whereby a volume control on the hearing aid is received in said recess when terminals of the hearing aid are connected to said at least one connector to insure the polarity of the hearing aid battery is the same as the polarity of said at least one contact of said connector.

6. The charger as defined in claim 5, wherein said casing further includes an LED coupled to said at least contact which is illuminated when the hearing aid terminals are connected to said at least one contact such that a circuit within said charger is completed by the hearing aid.

7. The charger as defined in claim 1, wherein one contact of said charger connector at least partially encircles said recess and another contact of said charger connector at least partially encircles said one charger contact.

8. The charger as defined in claim 1 wherein said source includes a solar cell.

* * * * *